US005530174A

United States Patent [19]

Kawamura et al.

[11] Patent Number: 5,530,174

[45] Date of Patent: Jun. 25, 1996

[54] METHOD OF VITRIFYING HIGH-LEVEL RADIOACTIVE LIQUID WASTE

[75] Inventors: Kazuhiro Kawamura, Naka-gun; Masayuki Yoneya; Kenichi Sasage, both of Hitachinaka, all of Japan

[73] Assignee: Doryokuro Kakunenryo Kaihatsu Jigyodan, Tokyo-to, Japan

[21] Appl. No.: 520,786

[22] Filed: Aug. 30, 1995

[30] Foreign Application Priority Data

Feb. 28, 1995 [JP] Japan ..... 7-40129

[51] Int. Cl.[6] ..... G21F 9/00

[52] U.S. Cl. ..... 588/12; 501/152; 501/155; 976/DIG. 385

[58] Field of Search ..... 588/12; 501/155, 501/152, 153, 154; 976/DIG. 385

[56] References Cited

U.S. PATENT DOCUMENTS

| | | | |
|---|---|---|---|
| 4,097,401 | 6/1978 | Guber et al. | 588/12 |
| 4,209,421 | 6/1980 | Heimerl et al. | 588/15 |
| 4,464,294 | 8/1984 | Thiele | 588/11 |
| 4,772,431 | 9/1988 | Aubert | 588/12 |
| 4,797,232 | 1/1989 | Aubert | 588/12 |

OTHER PUBLICATIONS

Sasage et al., "M15 Phase Separation in Highly Waste Loaded Glass", Preliminary Report of 1994 Fall Meeting of The Atomic Energy Society of Japan (Sep. 28–30, 1994), Published Sep. 5, 1994.

*Primary Examiner*—Ngoclan Mai
*Attorney, Agent, or Firm*—Wenderoth, Lind & Ponack

[57] ABSTRACT

A method of vitrifying a high-level radioactive liquid waste comprising removing a precipitate composed mainly of Mo and Zr from the high-level liquid waste, mixing the resulting high-level liquid waste with a raw glass material having a chemical composition wherein the $B_2O_3/SiO_2$, $ZnO/Li_2O$ and $Al_2O_3/Li_2O$ ratios are at least 0.41, at least 1.00 and at least 2.58, respectively, and melt-solidifying the mixture to thereby form a vitrified waste. By using such a raw glass material, there can be obtained a vitrified waste having the waste content of about 45% by oxide weight in which the same leaching rate as that of a conventional vitrified waste having the waste content of 25% by oxide weight is ensured without suffering from yellow phase separation.

2 Claims, No Drawings

METHOD OF VITRIFYING HIGH-LEVEL RADIOACTIVE LIQUID WASTE

BACKGROUND OF THE INVENTION

The present invention relates to a method of vitrifying a high-level radioactive liquid waste generated in the step of reprocessing spent nuclear fuels. More particularly, the present invention is concerned with a vitrification method by which a vitrified waste having a high waste content can be obtained.

A high-level radioactive liquid waste (hereinafter referred to simply as "high-level liquid waste",) is generated in the step of separating U and Pu by reprocessing spent nuclear fuels generated in nuclear power stations. This high-level liquid waste contains various components such as fission products contained in spent nuclear fuels in the form of a solution in nitric acid or a precipitate in a nitric acid medium without being dissolved. Further, the high-level liquid waste contains Na added as a reagent in the reprocessing step and also Fe, Cr and Ni which are corrosion products.

Such a high-level liquid waste is mixed with a raw glass material consisting mainly of $SiO_2$ and $B_2O_3$ in a glass melting furnace at high temperatures and melt-solidified into a vitrified waste. In this process, the nitrate component in the high-level liquid waste is removed in the form of steam and $NO_x$ while the fission products are homogeneously mixed with the raw glass material and vitrified. The resultant vitrified waste is stored for cooling for 30 to 50 years and thereafter disposed of in a stratum more than hundreds of meters deep underground.

Table 1 gives some examples of the chemical compositions of raw glass materials conventionally employed in the vitrification of a high-level liquid waste by Power Reactor and Nuclear Fuel Development Corporation (Doryokuro Kakunenryo Kaihatsu Jigyodan) who is the assignee of the present invention.

TABLE 1

Examples of chemical compositions of conventional raw glass materials

[unit: wt. %]

| component | Designation of raw glass material compsn. | | |
|---|---|---|---|
| | PF500 | PF606 | PF798 |
| $SiO_2$ | 61.83 | 68.52 | 62.30 |
| $B_2O_3$ | 20.18 | 19.60 | 19.00 |
| $Al_2O_3$ | 5.04 | 3.50 | 6.70 |
| CaO | 2.88 | 1.39 | 4.00 |
| ZnO | 2.88 | 1.39 | 4.00 |
| $Li_2O$ | 4.32 | 2.80 | 4.00 |
| miscellaneous | 2.88 | 2.79 | 0.00 |
| component ratio | | | |
| $B_2O_3/SiO_2$ | 0.33 | 0.29 | 0.31 |
| $ZnO/Li_2O$ | 0.67 | 0.50 | 1 |
| $Al_2O_3/Li_2O$ | 1.17 | 1.25 | 1.68 |

In the conventional vitrification, the waste such as fission products and the raw glass material are mixed generally in proportions of about 25% (on the basis of oxide weight, the same shall apply hereinafter) of the waste and about 75% of the raw glass material. That is, the raw glass material is contained in the vitrified waste in an amount about thrice greater than that of the waste components such as fission products to be primarily vitrified. This is because, when the waste content is increased while lowering the proportion of the raw glass material, the phenomenon called phase separation occurs such that a water-soluble separated phase composed mainly of Mo which is known as "yellow phase", is separated in the vitrified waste, thereby gravely deteriorating the nuclide confinement performance of the vitrified waste. Further, the fission products contained in the waste generate heat in accordance with their decay, so that an increase in the waste content of the vitrified waste raises the temperature of the central part of the vitrified waste to thereby change the properties of the vitrified waste. This is also the reason for the incapability of increasing the waste content of the vitrified waste.

For highly reducing the volume of the vitrified waste, it is desired to develop a method of vitrifying a high-level liquid waste in which, even if the waste content of the vitrified waste is increased over the conventional level of about 25%, the same leaching rate as that of the conventional vitrified waste is ensured without suffering from the yellow phase separation.

SUMMARY OF THE INVENTION

An object of the present invention is therefore to provide a method of producing a vitrified waste in which, even if the waste content of the vitrified waste is increased over the conventional level of 25%, the same leaching rate as that of the conventional vitrified waste is ensured without suffering from the yellow phase separation.

The inventors have noted the fact that the precipitate formed in the high-level liquid waste is composed mainly of Mo and Zr and have attempted to vitrify a high-level liquid waste from which the precipitate has been removed by separation prior to vitrification with the use of the conventional raw glass materials. However, when the waste content of the vitrified waste is increased to as high as 45% , it has been impossible to suppress the yellow phase precipitation. Thus, the chemical composition of the employed raw glass material has widely been studied. As a result, it has been found that the employment of a raw glass material having a chemical composition wherein $SiO_2$, $B_2O_3$, $Li_2O$, ZnO and $Al_2O_3$ as the glass components are contained in specific proportions enables not only suppression of the yellow phase separation but also retention of a given leaching rate even when the waste content of the vitrified waste is increased to as high as 45%. The present invention has been accomplished on the basis of the above finding.

The method of vitrifying a high-level liquid waste according to the present invention comprises removing a precipitate composed mainly of Mo and Zr from a high-level liquid waste, mixing the resulting high-level liquid waste with a raw glass material having a chemical composition wherein the $B_2O_3/SiO_2$, $ZnO/Li_2O$ and $Al_2O_3/Li_2O$ ratios are at least 0.41, at least 1.00 and at least 2.58, respectively, and melt-solidifying the mixture to thereby form a vitrified waste.

Eighty-percent or more of Mo which is present in the high-level liquid waste and causes the yellow phase separation limiting the waste content of the vitrified waste is contained in the precipitate formed in the liquid waste. This precipitate contains Zr as well as Mo. In the present invention, therefore, the precipitate is removed from the high-level liquid waste by solid-liquid separation technique such as filtration prior to the vitrification. This enables removal of about 80% of Mo contained in the liquid waste.

The high-level liquid waste having the precipitate removed by separation is mixed with the raw glass material in given proportions and melt-solidified in a glass melting furnace into a vitrified waste. Conventional melt-solidification conditions can be employed. In the present invention, however, the use of a raw glass material having a specific chemical composition enables the waste content of the vitrified waste to be increased to a value higher than the 25%, for example, about 45%.

The chemical composition of the raw glass material to be used in the present invention is based on the conventional one of PF798 of Table 1 and involves the modification thereof. More specifically, the component $SiO_2$ of the PF798 has been replaced within the range of 3.7 to 4.6% by $B_2O_3$ effective in suppressing the phase separation, thereby raising the ratio of $B_2O_3/SiO_2$ to 0.41 or higher. Further, the component $Li_2O$ of the PF798 has been replaced within the range of 0 to 3.6% by ZnO, thereby raising the ratios of $ZnO/Li_2O$ and $Al_2O_3/Li_2O$ to at least 1.00 and at least 2.58, respectively, for improving the chemical durability of the vitrified waste. With respect to any vitrlfled waste produced with the use of a raw glass material having a chemical composition which does not satisfy the above requirements, an increase in the waste content to 45% leads to incapability of retaining the conventional level of leaching rate although no phase separation is observed by visual inspection.

PREFERRED EMBODIMENTS OF THE INVENTION

The present invention will now be described in detail with reference to the following Examples.

High-Level Liquid Waste

The chemical composition of the employed simulated high-level liquid waste SW-11NP is as specified in Table 2. The parenthesized values in the Table signify the replacement by another element. More precisely, the elements of the platinum group (Ru, Rh and Pd) were replaced by the lighter elements in the other period of the same group (Fe, Co and Ni), respectively. Pm was replaced by Nd whose atomic number is smaller than that of Pm by one, and actinide elements U, Np, Pu, Am and Cm were replaced by Ce. Therefore, the content of each of the above elements Fe, Co, Ni, Nd and Ce employed for replacement includes that of the element introduced for the replacement. Tc not listed in the Table was replaced by Mn, and the content of Mn includes that of the element introduced for replacing Tc.

TABLE 2

Chemical composition of simulated high-level liquid waste SW-11NP

[unit: g/l]

| Oxide | Content |
|---|---|
| $Na_2O$ | 30.4 |
| $P_2O_5$ | 0.901 |
| $Fe_2O_3$ | 8.453 |
| $Cr_2O_3$ | 0.73 |
| NiO | 1.76 |
| $Rb_2O$ | 0.34 |
| $Cs_2O$ | 2.269 |
| SrO | 0.91 |
| BaO | 1.49 |
| $ZrO_2$ | 4.448 |
| $MoO_3$ | 4.404 |
| $MnO_2$ | 1.139 |
| $RuO_2$ | (2.249) |
| $Rh_2O_3$ | (0.43) |
| PdO | (1.06) |
| CoO | 0.43 |
| $Ag_2O$ | 0.04 |

TABLE 2-continued

Chemical composition of simulated high-level liquid waste SW-11NP

[unit: g/l]

| Oxide | Content |
|---|---|
| CdO | 0.06 |
| $SnO_2$ | 0.05 |
| $SeO_2$ | 0.06 |
| $TeO_2$ | 0.57 |
| $Y_2O_3$ | 0.55 |
| $La_2O_3$ | 1.29 |
| $CeO_2$ | 10.138 |
| $Pr_6O_{11}$ | 1.27 |
| $Nd_2O_3$ | 4.206 |
| $Pm_2O_3$ | (0.04) |
| $Sm_2O_3$ | 0.889 |
| $Eu_2O_3$ | 0.14 |
| $Gd_2O_3$ | 0.07 |
| $UO_3$, $NpO_2$, $PuO_2$, $Am_2O_3$, $Cm_2O_3$ | (7.513) |

In the present invention, the precipitate composed mainly of Mo and Zr is removed from the high-level liquid waste before vitrification. Thus, simulated liquid waste SW-22 having the concentrations of $MoO_3$ and $ZrO_2$ each reduced to about 50% in the chemical composition of the above liquid waste SW-11NP was prepared with the assumption of removal of part of the precipitate (assuming removal of about 50% of each of Mo and Zr). Further, with the assumption of the case where the content of Mo in the precipitate was low depending on the change of the chemical composition of the precipitate present in the liquid waste, simulated liquid waste SW-22M was prepared which had the concentrations of $MoO_3$ and $ZrO_2$ reduced to about 75% (assuming removal of about 25% of Mo) and about 50% (assuming removal of about 50% of Zr), respectively, in the chemical composition of the above liquid waste SW-11NP. In the practical vitrification, each of the above simulated liquid wastes SW-22 and SW-22M was used.

Raw Glass Material

The type and chemical composition of each of the raw glass material employed in the Examples and Comparative Examples are specified in Table 3. The chemical composition of the raw glass material PF798 as a standard in Table 3 is one given in Table 1 which has been employed by Power Reactor and Nuclear Fuel Development Corporation.

In the preparation of each raw glass material, the individual components were blended in a batch of 100 g. Each component was weighed in the form of an oxide, phosphate, carbonate, nitrate, sodium salt or chloride and mixed by milling in an alumina mortar.

TABLE 3

Chemical composition of raw glass material

[unit: wt. %, total: 100 wt. %)

| | Standard | Comp. Ex. | | Ex. | | |
|---|---|---|---|---|---|---|
| component | PF798 | PF-A | PF-B | PF-C | PF-D | PF-E |
| $SiO_2$ | 62.3 | 58.6 | 56.8 | 55.0 | 55.0 | 55.0 |
| $B_2O_3$ | 19.0 | 20.9 | 22.7 | 22.7 | 22.7 | 23.6 |
| $Al_2O_3$ | 6.7 | 8.5 | 8.5 | 10.3 | 10.3 | 9.4 |
| CaO | 4.0 | 4.0 | 4.0 | 4.0 | 4.0 | 4.0 |
| ZnO | 4.0 | 4.0 | 4.0 | 4.0 | 5.8 | 7.6 |

TABLE 3-continued

| Chemical composition of raw glass material [unit: wt. %, total: 100 wt. %] | | | | | | |
|---|---|---|---|---|---|---|
| | Standard | Comp. Ex. | | Ex. | | |
| component | PF798 | PF-A | PF-B | PF-C | PF-D | PF-E |
| $Li_2O$ | 4.0 | 4.0 | 4.0 | 4.0 | 2.2 | 0.4 |
| component ratio | | | | | | |
| $B_2O_3/SiO_2$ | 0.31 | 0.36 | 0.40 | 0.41 | 0.41 | 0.43 |
| $ZnO/Li_2O$ | 1.00 | 1.00 | 1.00 | 1.00 | 2.64 | 19.00 |
| $Al_2O_3/Li_2O$ | 1.68 | 2.13 | 2.13 | 2.58 | 4.68 | 23.50 |

Production of Vitrified Waste

Each of the simulated liquid wastes SW-22 and SW-22M was mixed with each of the raw glass materials having the chemical compositions as specified in Table 3, transferred into a platinum beaker and melted by means of an electric furnace. The melting temperature was set at 1100° C. and each batch was heated for 2.5 hr after the charging thereof. The melt was agitated with a quartz rod thrice at intervals of 15 min starting 1 hr after the initiation of the heating. Subsequently, the melt was allowed to flow on a metal plate and to naturally cool in the air at room temperature. Thus, a vitrified waste having a waste content of 45% was prepared by the above procedure.

In addition, a vitrified waste having a waste content of 25% was prepared with the use of the conventional raw glass material PF798 to provide a control for comparison of the properties.

The chemical compositions of the resultant vitrified wastes are collectively given in Table 4.

TABLE 4

| Chemical composition of vitrified waste [unit: wt. %] | | | | | | | | |
|---|---|---|---|---|---|---|---|---|
| Waste content | Content of raw glass material | Designation of chem. compsn. of raw glass material | Chem. compsn. of glass component | | | | | |
| | | | $SiO_2$ | $B_2O_3$ | $Li_2O$ | CaO | ZnO | $Al_2O_3$ |
| 25 | 75 | PF798 | 46.72 | 14.25 | 3.00 | 3.00 | 3.00 | 5.03 |
| 45 | 55 | PF798 | 34.27 | 10.45 | 2.20 | 2.20 | 2.20 | 3.69 |
| | | PF-A | 32.27 | 11.45 | 2.20 | 2.20 | 2.20 | 4.69 |
| | | PF-B | 31.27 | 12.45 | 2.20 | 2.20 | 2.20 | 4.69 |
| | | PF-C | 30.27 | 12.45 | 2.20 | 2.20 | 2.20 | 5.69 |
| | | PF-D | 30.27 | 12.45 | 1.20 | 2.20 | 3.20 | 5.69 |
| | | PF-E | 30.27 | 12.95 | 0.20 | 2.20 | 4.20 | 5.19 |

Evaluation of Properties of Vitrified Waste

The results of evaluation of each vitrified waste specimen with respect to the occurrence of yellow phase separation and leaching rate (total weight loss rate) are collectively given in Table 5. The measuring methods were as follows.

Occurrence of yellow phase separation: visually inspected.

Leaching rate: determined as follows. Each vitrified waste specimen was milled into 250 to 420 μm particles. 1 g thereof was immersed in 50 ml of distilled water at 98° C. for 24 hr and the resultant weight loss was measured. The total weight loss rate was calculated by dividing the above weight loss by the surface area of the specimen obtained by multiplying the specific surface area determined according to the B.E.T. method by 1 g as the specimen weight. When the total weight loss ratio is $4\times10^{-4}$ kg/m$^2$ d or less, the vitrified waste has been evaluated as being on a par in leaching rate with the conventional vitrified waste.

TABLE 5

| Evaluation of properties of vitrified waste | | | | | | | | |
|---|---|---|---|---|---|---|---|---|
| | | Designation of | simulated liq. waste SW-22 | | | simulated liq. waste SW-22M | | |
| Waste content | Content of glassifying material | glassifying material compsn. | $MoO_3$ concn. of vitrified waste | Occurrence of phase separation | Total wt. loss ratio (kg/m$^2$ · d) | $MoO_3$ concn. of vitrified waste | Occurrence of phase separation | Total wt. loss ratio (kg/m$^2$ · d) |
| 25% | 75% | PF798 | 0.73% | none | $2.8 \times 10^{-4}$ | 1.12% | none | $3.2 \times 10^{-4}$ |
| 45% | 55% | PF798 | 1.62% | found | $5.2 \times 10^{-4}$ | 2.50% | found | $4.3 \times 10^{-4}$ |
| | | PF-A | | none | $3.5 \times 10^{-4}$ | | none | $4.6 \times 10^{-4}$ |
| | | PF-B | | none | $4.2 \times 10^{-4}$ | | none | $6.1 \times 10^{-4}$ |

TABLE 5-continued

| | | | Evaluation of properties of vitrified waste | | | | | |
|---|---|---|---|---|---|---|---|---|
| | | Designation of | simulated liq. waste SW-22 | | | simulated liq. waste SW-22M | | |
| Waste content | Content of glassifying material | glassifying material compsn. | $MoO_3$ concn. of vitrified waste | Occurrence of phase separation | Total wt. loss ratio ($kg/m^2 \cdot d$) | $MoO_3$ concn. of vitrified waste | Occurrence of phase separation | Total wt. loss ratio ($kg/m^2 \cdot d$) |
| | | PF-C | | none | $3.1 \times 10^{-4}$ | | none | $3.8 \times 10^{-4}$ |
| | | PF-D | | none | $2.8 \times 10^{-4}$ | | none | $3.6 \times 10^{-4}$ |
| | | PF-E | | none | $2.5 \times 10^{-4}$ | | none | $1.7 \times 10^{-4}$ |

With respect to both the simulated liquid wastes SW-22 (about 50% of Mo removed from the liquid waste) and SW-22M (about 25% of Mo removed from the liquid waste), it is apparent from Table 5 that whenever any of the raw glass materials PF-C, PF-D and PF-E (Examples) having the given component ratios is used, there is no occurrence of yellow phase separation and the leaching rate can be held on a par with that of the conventional vitrified waste (standard) even if the waste content is increased to 45%. In contrast, the vitrified waste produced with the use of either of raw glass materials PF-A and PF-B (Comparative Examples) not having any given component ratio which has a waste content of 45% is inferior in leaching rate to the conventional vitrified waste although there is no yellow phase separation observed.

As apparent from the foregoing description, according to the present invention, a vitrified waste in which, even if the waste content of the vitrified waste is increased over the conventional level of 25%, the same leaching rate as that of the conventional vitrified waste is ensured without suffering from yellow phase separation can be obtained by melt-solidifying a mixture of a high-level liquid waste having the precipitate removed therefrom and a raw glass material having a chemical composition wherein the $B_2O_3/SiO_2$, $ZnO/Li_2O$ and $Al_2O_3/Li_2O$ ratios are at least 0.41, at least 1.00 and at least 2.58, respectively. Therefore, the present invention enables an effective volume-reduction of the vitrified waste in the vitrification of a high-level liquid waste.

What is claimed is:

1. A method of vitrifying a high-level radioactive liquid waste comprising removing a precipitate composed mainly of Mo and Zr from the high-level radioactive liquid waste, mixing the resulting high-level radioactive liquid waste with a raw glass material having a chemical composition wherein the $B_2O_3/SiO_2$, $ZnO/Li_2O$ and $Al_2O_3/Li_2O$ ratios are at least 0.41, at least 1.00 and at least 2.58, respectively, and melt-solidifying the mixture to thereby form a vitrified waste.

2. The method of vitrifying a high-level radioactive liquid waste according to claim 1, wherein the precipitate-removed liquid waste and the raw glass material are mixed in a proportion to form the vitrified waste having a waste content of about 45% by oxide weight and the raw glass material of about 55% by oxide weight.

* * * * *